US007874122B2

(12) United States Patent
Calle

(10) Patent No.: US 7,874,122 B2
(45) Date of Patent: Jan. 25, 2011

(54) METHODS FOR CREATING FOOTINGS

(75) Inventor: Jonathan S. Calle, Birchrunville, PA (US)

(73) Assignee: Strata Systems, Incorporated, Cumming, GA (US)

( * ) Notice: Subject to any disclaimer, the term of this patent is extended or adjusted under 35 U.S.C. 154(b) by 0 days.

(21) Appl. No.: 12/489,129

(22) Filed: Jun. 22, 2009

(65) Prior Publication Data

US 2010/0018152 A1 Jan. 28, 2010

Related U.S. Application Data

(60) Division of application No. 11/399,958, filed on Apr. 7, 2006, now Pat. No. 7,549,259, which is a continuation-in-part of application No. 10/957,857, filed on Oct. 4, 2004, now Pat. No. 7,562,502.

(60) Provisional application No. 60/508,713, filed on Oct. 3, 2003.

(51) Int. Cl.
*E04B 1/00* (2006.01)

(52) U.S. Cl. ..... 52/741.3; 52/166; 52/167.3; 52/155; 52/167.2

(58) Field of Classification Search ..... 52/166, 52/167.3, 155, 167.2, 741.11, 741.14, 741.15, 52/296, 297, 298, 701, 704, 707, 170, 741.3, 52/745.04, 745.12; 256/31, 65.14
See application file for complete search history.

(56) References Cited

U.S. PATENT DOCUMENTS

| | | | | |
|---|---|---|---|---|
| 837,820 | A | 12/1906 | Folsom et al. | |
| 1,596,657 | A | 8/1926 | Heber | |
| 1,679,297 | A * | 7/1928 | Ehrler | 52/165 |
| 3,316,721 | A | 5/1967 | Helig | |
| 3,694,978 | A | 10/1972 | Mintz | |
| 3,717,966 | A | 2/1973 | Reichert | |
| 3,785,107 | A * | 1/1974 | Garretson | 52/514 |
| 3,869,868 | A | 3/1975 | Irsai | |
| 3,915,434 | A * | 10/1975 | Lister | 256/59 |

(Continued)

FOREIGN PATENT DOCUMENTS

JP 61-172925 A1 8/1986

(Continued)

OTHER PUBLICATIONS

Patent Abstracts of Japan for Publication No. 61-172925 published Apr. 8, 1986.

(Continued)

*Primary Examiner*—Richard E Chilcot, Jr.
*Assistant Examiner*—Chi Nguyen
(74) *Attorney, Agent, or Firm*—Fox Rothschild LLP

(57) ABSTRACT

Methods are provided for creating footings for structures proximate a wall face of a segmental retaining wall using a device that includes a sleeve and a reinforcing member having a base. The methods can include placing the device on a layer of backfill material behind the wall face so that the sleeve is located adjacent the wall face and the base of the reinforcing member extends away from the wall face, covering the base of the reinforcing member with at least one other layer of the backfill material, placing a bottom portion of the structure in the sleeve, and filling the sleeve with an anchoring material.

20 Claims, 10 Drawing Sheets

U.S. PATENT DOCUMENTS

| | | | | |
|---|---|---|---|---|
| 3,946,992 | A | 3/1976 | Elias | |
| 4,056,942 | A | 11/1977 | Yoshida | |
| 4,137,576 | A | 2/1979 | Greene | |
| 4,244,156 | A * | 1/1981 | Watts, Jr. | 52/746.1 |
| 4,296,584 | A | 10/1981 | Lempa, Jr. | |
| 4,483,506 | A * | 11/1984 | Litwiller | 248/545 |
| 4,610,432 | A | 9/1986 | Lewis et al. | |
| 4,893,787 | A | 1/1990 | Watson | |
| 5,240,230 | A | 8/1993 | Dougherty | |
| 5,779,227 | A | 7/1998 | Elkins et al. | |
| 5,878,528 | A | 3/1999 | Pattyn | |
| 6,257,557 | B1 | 7/2001 | Anderson et al. | |
| 6,345,934 | B1 | 2/2002 | Jailloux | |
| 6,443,655 | B1 | 9/2002 | Bennett | |
| 6,527,255 | B2 | 3/2003 | O'Berry | |
| 7,044,449 | B2 * | 5/2006 | Wink | 256/24 |
| 7,055,806 | B2 | 6/2006 | York et al. | |
| 7,175,141 | B2 * | 2/2007 | Bolinder et al. | 248/156 |
| 7,549,259 | B2 * | 6/2009 | Calle | 52/297 |
| 7,562,502 | B2 * | 7/2009 | Calle | 52/297 |

FOREIGN PATENT DOCUMENTS

| | | | |
|---|---|---|---|
| WO | 96/23118 | A1 | 8/1996 |
| WO | 2005/033443 | A2 | 4/2005 |

OTHER PUBLICATIONS

Supplementary European Search Report for corresponding EP Application No. 04794066, dated Dec. 7, 2006.

* cited by examiner

METHODS FOR CREATING FOOTINGS

CROSS REFERENCE TO RELATED APPLICATIONS

This application is a divisional of U.S. application Ser. No. 11/399,958, filed on Apr. 7, 2006, now U.S. Pat. No. 7,549,259, which is a continuation-in-part of U.S. application Ser. No. 10/957,857, filed Oct. 4, 2004 now U.S. Pat. No. 7,562,502, which claims priority under 35 U.S.C. §119(e) to U.S. provisional application No. 60/508,713, filed on Oct. 3, 2003. The contents of each of these applications are incorporated by reference herein in their entireties.

TECHNICAL FIELD

The present invention related to the construction of footings for structures such as fence posts.

BACKGROUND

Segmental retaining walls are commonly used in both residential and commercial applications to create usable real estate. Fencing is often required behind such walls to reduce the potential for falls and other potential hazards. In addition, guardrails usually are required in applications where parking lots or roadways are located near top of the wall.

Fence posts typically are mounted using concrete footings. A concrete footing can be created by digging a cavity in the ground, placing a bottom portion of the fence post in the cavity, and pouring concrete into the cavity.

Segmental retaining walls often include a reinforcing tie back system. For example, multiple layers of geosynthetic soil reinforcing material (commonly referred to as "geogrid") can be secured to the wall face so that the layers extend horizontally into the surrounding stone or soil. The interaction between the stone or soil and the reinforcing material can help to stabilize the wall face, i.e., the portion of the wall formed by stacked concrete blocks.

Digging a cavity for a fence-post footing near a segmental retaining wall, after the reinforcing material has been installed, can necessitate drilling through the reinforcing material. Drilling through the reinforcing material can adversely affect the integrity thereof, and therefore is undesirable. Hence, the cavities for fence posts located near segmental retaining walls are usually created as the wall is constructed.

Fence-post cavities can be created using cylindrical cardboard forms, such as the SONOTUBE form available from Sonoco Products Company. These forms usually are provided in relatively long lengths, and therefore must be cut to a desired length at the installation site. The form is placed on the backfill material (typically soil) used behind that wall, as backfill material reaches a predetermined height. The predetermined height is chosen so that the top of the form is exposed from above ground after the wall has been completed, and all backfill material has been introduced and compacted. The form defines an open cavity in the ground that can receive the fence post.

The soil used as backfill material is usually kept moist, to help to achieve maximum density during compacting. Cardboard forms can be adversely affected by such moisture. Moisture from precipitation also can affect the integrity of a cardboard form. Also, the loads on the cardboard form resulting from the compacted backfill material, if excessive, can cause the form to collapse.

Alternatively, the form used to create the cavity can be created by cutting a predetermined length of polyvinyl chloride (PVC) or high-density polyethylene (HDPE) pipe. These materials are usually delivered to the installation site in ten or twenty-foot lengths. The need to cut the pipe creates an additional step in the construction process for the wall. Moreover, installers often cut the pipe using concrete demolition saws, chain saws, and other tooling not made for this particular use, thereby creating a potential safety hazard.

The cavity defined by the form creates a potential for injuries resulting from tripping over or stepping into an open hole in the ground. Moreover, the open cavity can fill with dirt and other debris, particularly in installations where fence posts will not be installed immediately after completion of the segmental retaining wall.

Many design codes, and many design engineers require that fence posts used near segmental retaining walls be placed at lest three feet from the wall face. This requirement is intended to minimize the potential for the fence post to affect the structural integrity of the wall face. In particular, a linear force placed on the fence post, in a direction toward the wall face, has the potential to cause overturning of the fence post foundation into the facing units of the segmental retaining wall. The linear force may also cause direct sliding of the fence post and footing toward the wall face. Such a force also introduces a moment on the fence post that can urge the fence post and footing toward the wall face. Movement of the fence post toward the wall face potentially can weaken, bulge, or overturn the wall face if the fence post is located too close to the wall face. Hence, fence posts often must be installed at least three feet from the face of a segmental retaining wall to avoid placing excessive loads on the wall face.

The real estate located between the wall face and the fence as a result of the three-foot setback requirement represents underutilized space. This area also creates a potential safety hazard. For example, individuals (and in particular, children) can fall from the setback area onto the surface in front of the wall.

The three-foot setback requirement usually places the sleeves at a location in the soil backfill behind the wall face (rather than in the crushed stone backfill used directly adjacent to the wall face.) This requirement can potentially interfere with the compacting operations performed on the backfill soil. For example, care must be exercise to avoid contacting the sleeves the equipment used to compact the soil. Moreover, the size of the compacting equipment may be limited by the need to maneuver around the sleeves.

The three-foot setback requirement also introduces the potential for the fence post to be installed too close to the wall face by mistake, in violation of design codes or site plans. In such cases, an entire fence may need to be removed and reinstalled at the proper location.

SUMMARY

Methods are provided for creating footings for structures proximate a wall face of a segmental retaining wall using a device that includes a sleeve and a reinforcing member having a base. The methods can include placing the device on a layer of backfill material behind the wall face so that the sleeve is located adjacent the wall face and the base of the reinforcing member extends away from the wall face, covering the base of the reinforcing member with at least one other layer of the backfill material, placing a bottom portion of the structure in the sleeve, and filling the sleeve with an anchoring material.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show an embodiment that is presently preferred. The invention is not limited, however, to the specific instrumentalities disclosed in the drawings. In the drawings.

DETAILED DESCRIPTION

Figure 1:
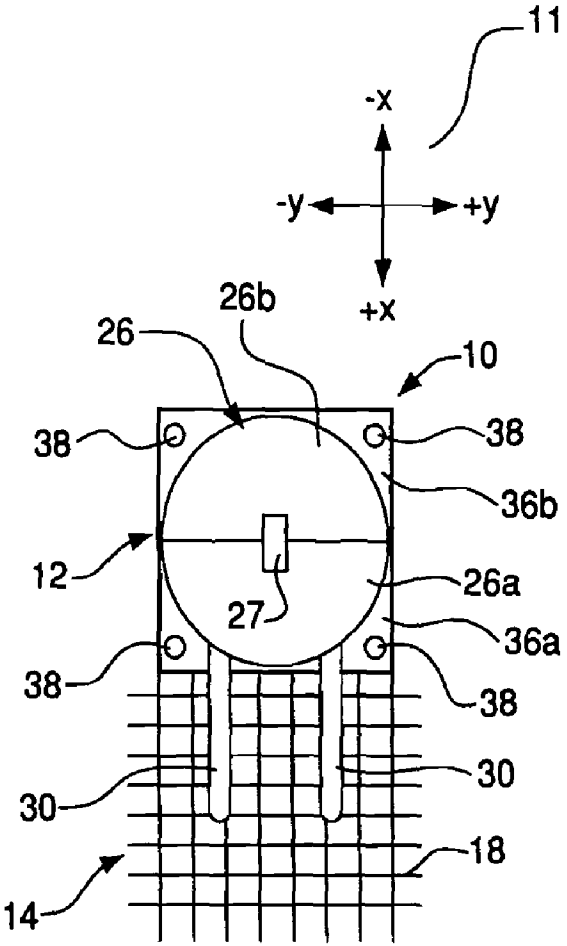
FIG. 1 is a top view of a preferred embodiment of a device for creating a footing for a fence post.

The figures depict a preferred embodiment (or various components) of a device 10 for constructing a footing for fence post. The figures are each referenced to a common coordinate system 11. The device 10 comprises a sleeve 12 and a reinforcing member 14. The reinforcing member 14 includes a leg 16, and an adjoining base 18.

The device 10 is described herein in connection with a fence post. This particular application is described for exemplary purposes only. The device 10 can be used to construct footings for other types of structures and structural components, such as (but not limited to) light posts, sign posts, guard rail posts, etc. (The term "structure," as used throughout the specification and claims, is intended to encompasses structures, and structural components.)

Figure 2:
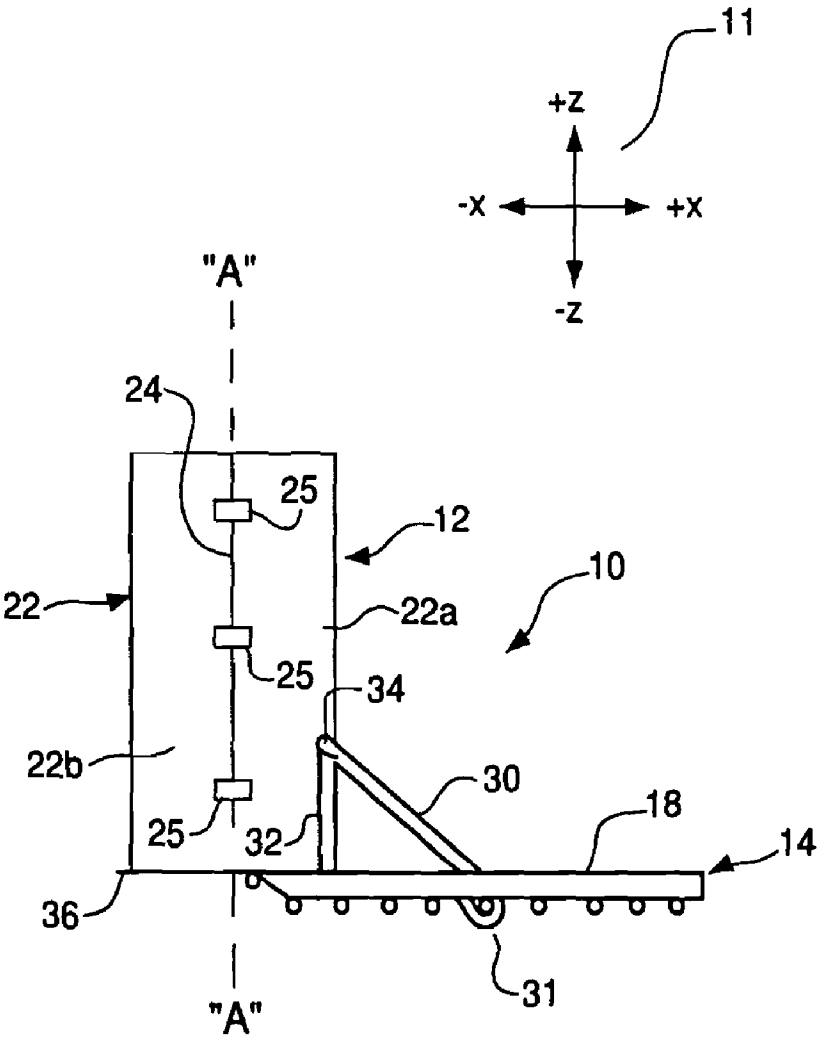
FIG. 2 is a side view of the device shown in FIG. 1.
Figure 5:
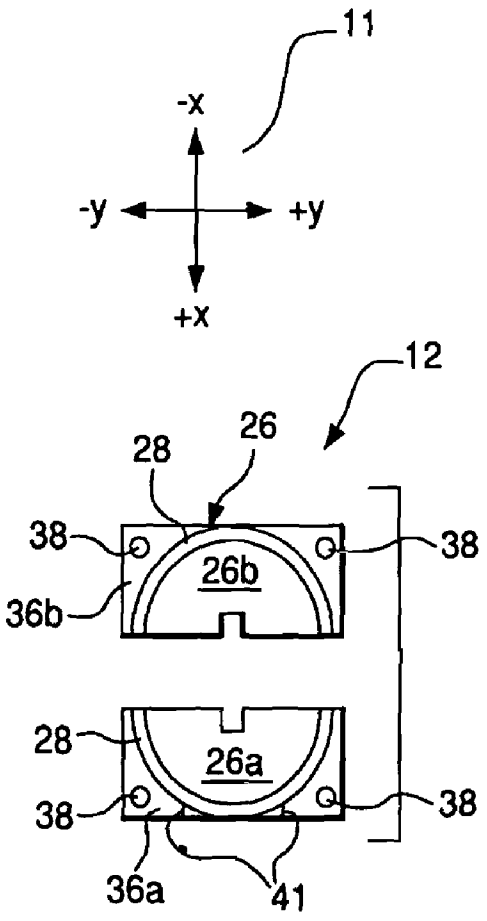
FIG. 5 is a top exploded view of the sleeve shown in FIGS. 3 and 4.
Figure 11:
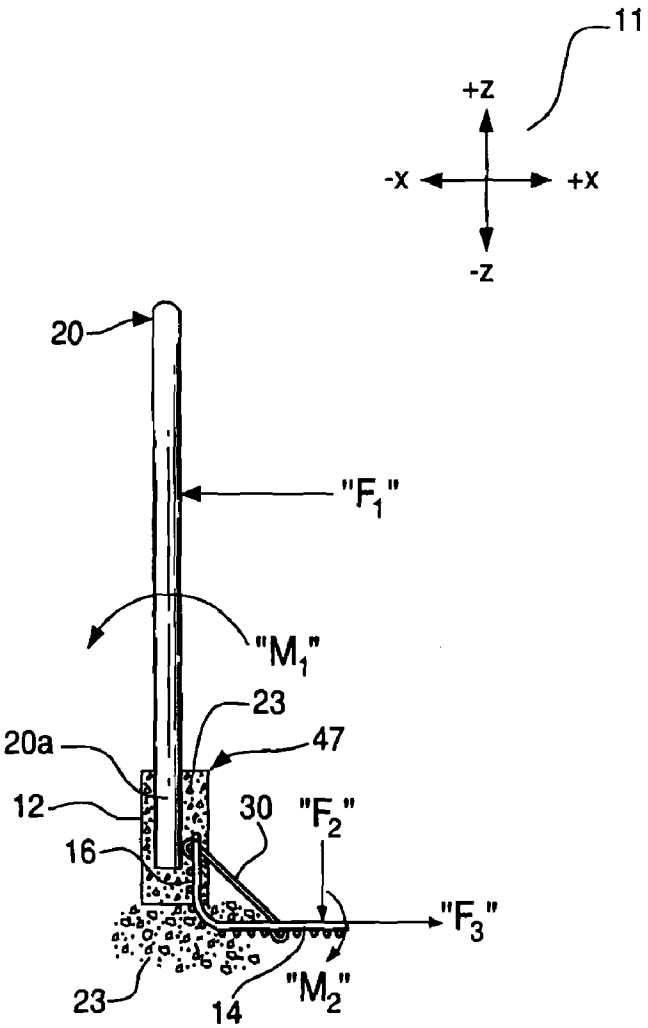
FIG. 11 is a cross-sectional side view of a fence-post footing constructed using the device shown in FIGS. 1, 2, and 10.

The sleeve 12 preferably attaches to the reinforcing member 14 so that the leg 16 is positioned within the sleeve 12, and the base 18 extends from the sleeve 12 (see FIGS. 1, 2, and 11). The sleeve 12 also receives a lower portion 20*a* of a fence post 20 (see FIG. 10). The device 10 can be buried at an approximate desired location for the fence post 20, so that the top of the sleeve 12 is accessible from above-grade.

An anchoring material, such as 3,000 psi concrete 23, can be poured into the sleeve 12 after the lower portion 20*a* of the fence post 20 has been placed therein (see FIG. 11). (The use of 3,000 psi concrete as the anchoring material is specified for exemplary purposes only. Other types of anchoring materials can be used in the alternative.)

The concrete 23, upon hardening, anchors the fence post 20 to the leg 16 of the reinforcing member 14. The struts 30 connect the leg 16 to the base 18. The base 18 of the reinforcing member 14 can interact with the surrounding backfill material, e.g., soil, crushed stone, etc., to generate forces that resist bending moments and linear forces on the fence post 20. Further details relating to these features are presented below.

The sleeve 12 has a main portion 22 (see FIGS. 1-5). The main portion 22 preferably is a cylindrical tube. (The main portion 22 can have a cross section other than circular in alternative embodiments. For example, the sleeve 12 can be formed with a square cross section.)

Figure 4:
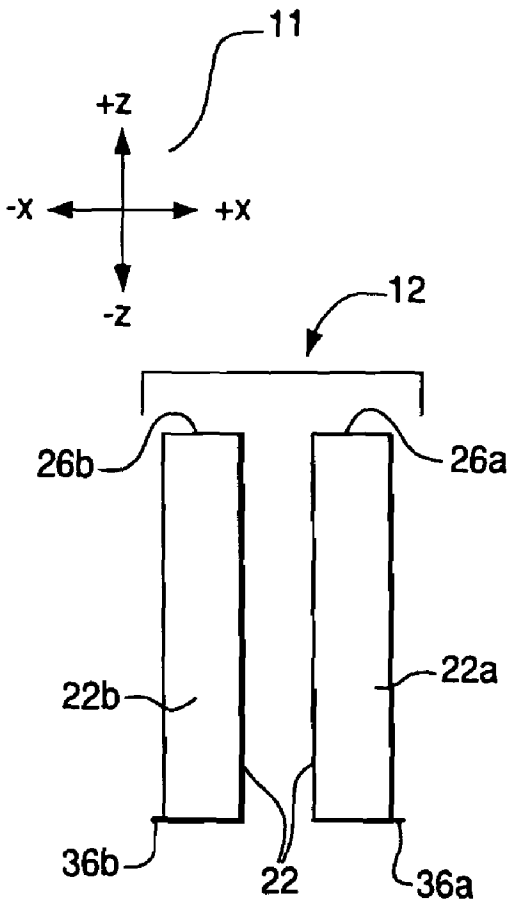
FIG. 4 is an exploded side view of the sleeve shown in FIG. 3, from a perspective displaced ninety degrees from the perspective of FIG. 3.

The main portion 22 of the sleeve 12 preferably has two diametrically opposed split lines 24 (see FIGS. 2 and 4). The split lines 24 separate the main portion 22 into a first half 22*a* and a second half 22*b*. The first half 22*a* can be secured to the second half 22*b* by a suitable means, such as latches 25, that permit the first and second halves 22*a*, 22*b* to be joined in a relatively quick manner (the latches 25 are shown in FIG. 2 only, for clarity). (Other means for securing the first and second halves 22*a*, 22*b*, e.g., fasteners, can be used in alternative embodiments.)

Figure 13:
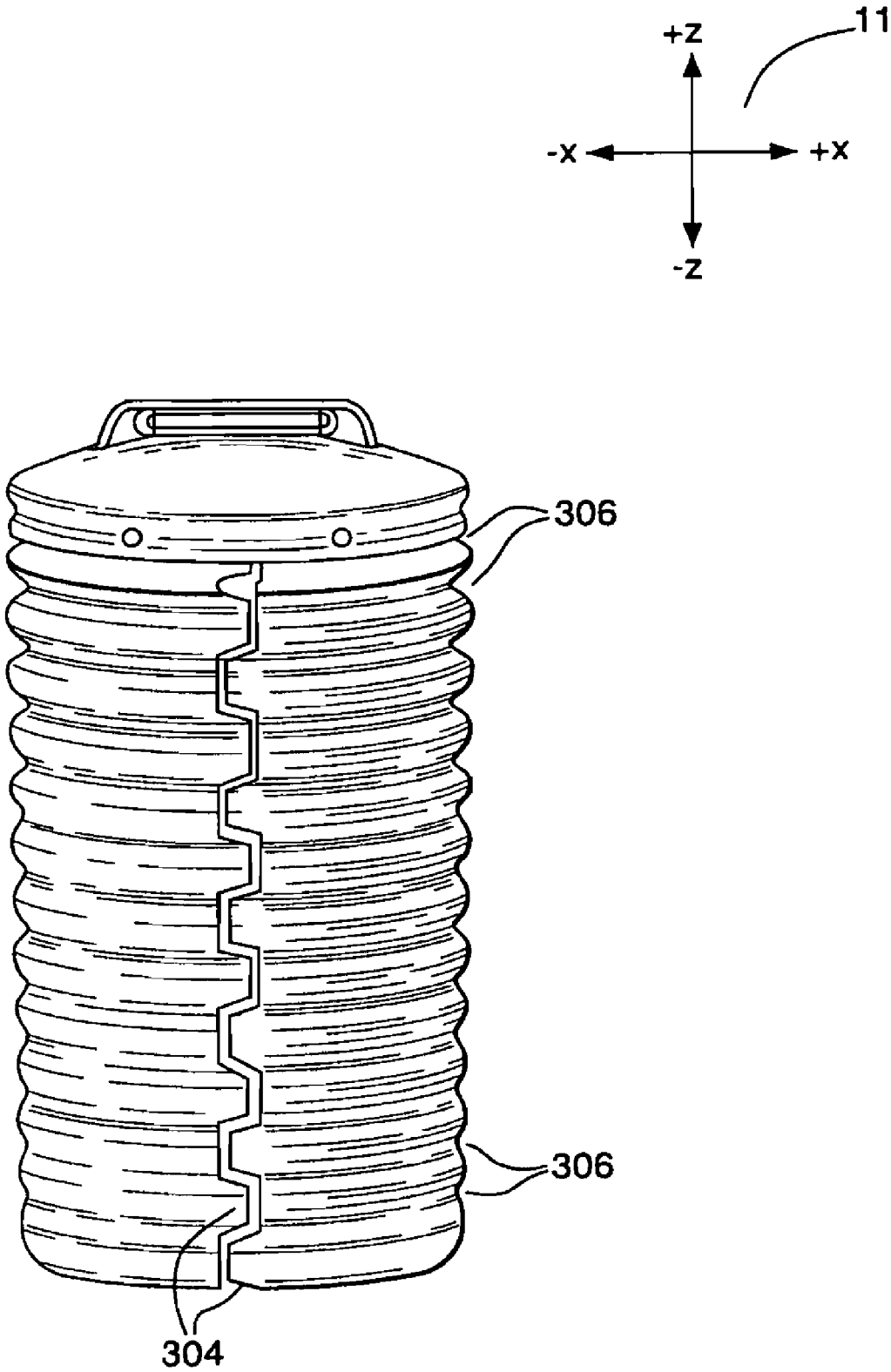
FIG. 13 is a side view of an alternative embodiment of the sleeve shown in FIGS. 3-5.

Alternatively, the first half 22*a* can be secured to the second half 22*b* by interweaving and interlocking finger sets 304, as shown in FIG. 13. The finger sets 304 are molded into the first and second halves 22*a*, 22*b* during manufacture thereof. The finger sets 304 are believed to facilitate relatively quick assembly of the main portion 22 and, in some applications, may eliminate the need for additional hardware to secure the first half 22*a* to the second half 22*b*.

Additional hardware may be necessary in some applications to secure the first half 22*a* to the second half 22*b*. For example, in applications where the sleeve 12 is to be pre-assembled for later use, it may be necessary to use additional hardware to secure the first half 22*a* to the second half 22*b* during transport. One example of such additional hardware is plastic cable ties as are commonly used in a variety of other construction-related activities. The cable tie can be placed around the first and second halves 22*a* and 22*b*, and then synched to drive the first and second halves 22*a* and 22*b* together, thereby creating the main portion 22 prior to installation.

The use of additional hardware to secure first half 22*a* to the second half 22*b* prior to installation may be necessary in some applications to maintain the integrity of the main portion 22 prior to backfilling that area around the main portion 22. Once the backfill is added around the main portion, the backfill will prevent the sleeve halves 22*a* and 22*b* from coming apart. The interweaving and interlocking finger sets 304 can help prevent the main portion 22 from imploding under the structural load generated from the backfill material and construction activities around the main portion 12.

In applications in which the length and diameter of the sleeve 12 are too large to permit the sleeve 12 to be packaged and/or installed effectively, the sleeve 12 can be modified relatively easily to address the packaging or installation issues. For example, the main portion 22 can be split into the first half 22*a* and the second half 22*b*, and in addition, each of the first and second halves 22*a*, 22*b* can have a laterally-extending split line, i.e., each of the first and second halves can be split into top and bottom portions. This configuration can allow tacking of the sleeve 12 in sections during installation, and can permit more compact and efficient nesting of components of the sleeve 12 during packaging and shipping: The components of the main portion 22 can be equipped with a female coupler to assist in the vertical stacking of the components. The female couplers can be formed in components with a relatively simple mold modification.

In applications where the geogrid 56 needs to intersect the sleeve 12, it is preferred that the geogrid 56 is able to pass through the sleeve 12, so that a portion of the geogrid 56 is located within the sleeve 12. This arrangement, it is believed, enables the geogrid 56 to contribute to the overall stability of the device 10 when the sleeve 12 is filled with concrete 23. This arrangement can be achieved relatively easily when, as discussed above, the first and second halves 22*a*, 22*b* of the sleeve 22 are split laterally, and a bottom portion and male end of the upper piece of each half 22*a*, 22*b* is attached to the top portion and female coupler of the corresponding lower piece.

The diameter of the main portion 22 should be sufficient to permit the main portion 22 to accommodate the lower portion 20*a* of the fence post 20, and the leg 16 of the reinforcing member 14. The optimal length of the main portion 22 is application dependent, and can vary with factors such as the amount of force the device 10 needs to produce to counteract bending moments and linear forces on the fence post 20. Dependent on the diameter and length requirements there may be the need for an additional main portion 22 to be stacked on top of the first main portion 22. In this case the first main portion 22 has a female end with the second main portion 22 having a male end to secure the second main portion 22 to the first.

Figure 3:
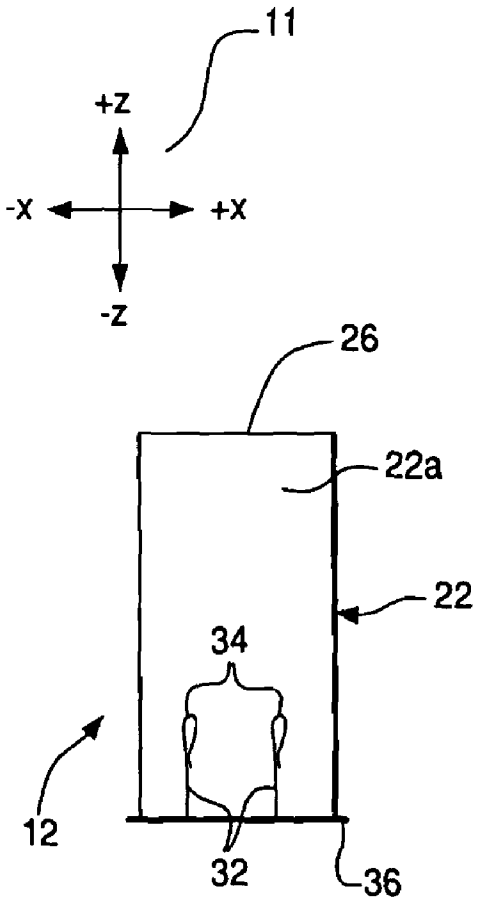
FIG. 3 is a side view of a sleeve of the device shown in FIGS. 1 and 2.
Figure 6:
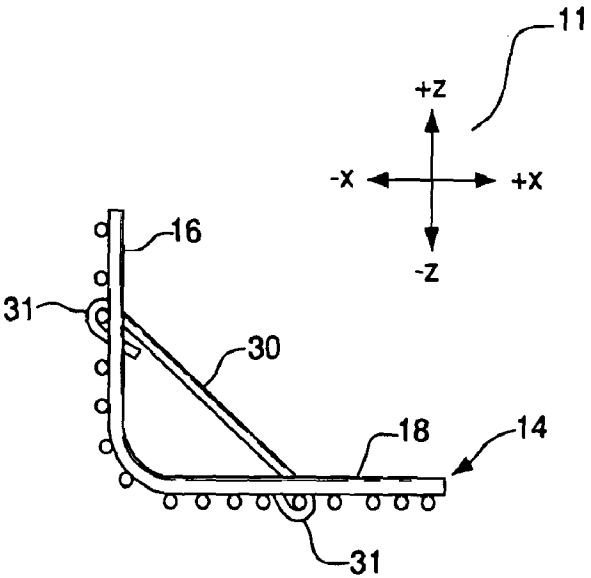
FIG. 6 is a side view of a reinforcing member and a strut of the device shown in FIGS. 1 and 2.

The first half 22*a* has two slits 32 formed therein (see FIG. 3). The slits 32 extend upward, from a bottom edge of the first half 22*a*. A respective opening 34 preferably is formed above, and adjoins each slit 32.

(Direction terms such as upper, lower, above, below, etc., are used with reference to the component orientations depicted in FIGS. 2, 10, and 11. These terms are used for illustrative purposes only, and are not intended to limit the scope of the appended claims.)

The sleeve 12 preferably includes a cover portion 26. The cover portion 26 is split into a first half 26*a* and a second half 26*b*. The first half 26*a* of the cover portion 26 adjoins the first half 22*a* of the main portion 22. The second half 26*b* of the cover portion 26 adjoins the second half 22*b* of the main portion 22.

Preferably, the first and second halves 26*a*, 26*b* each have an area 28 of reduced thickness extending along an outer perimeter thereof. In other words, the reduced-thickness areas 28 of the first and second halves 26*a*, 26*b* preferably adjoin the respective first and second halves 22*a*, 22*b* of the main portion 22.

The first and second halves 26*a*, 26*b* of the cover portion 26 define a notch 27 located at the approximate center of the cover portion 26.

The cover portion 26 may also be manufactured as a single piece in alternative embodiments. An area of reduced thickness, such as the area 28 of reduced thickness of the first and second halves 26*a*, 26*b*, can be formed around the outer perimeter of the single-piece cover portion 26, to facilitate relatively easy separation of the cover portion 26 and the main portion 22 using a simple cutting tool such as a utility knife. The secondary operation of cutting the single-piece cover portion 26 from the main portion 22 can be performed during the manufacturing process, and not after field assembly.

Figure 9:
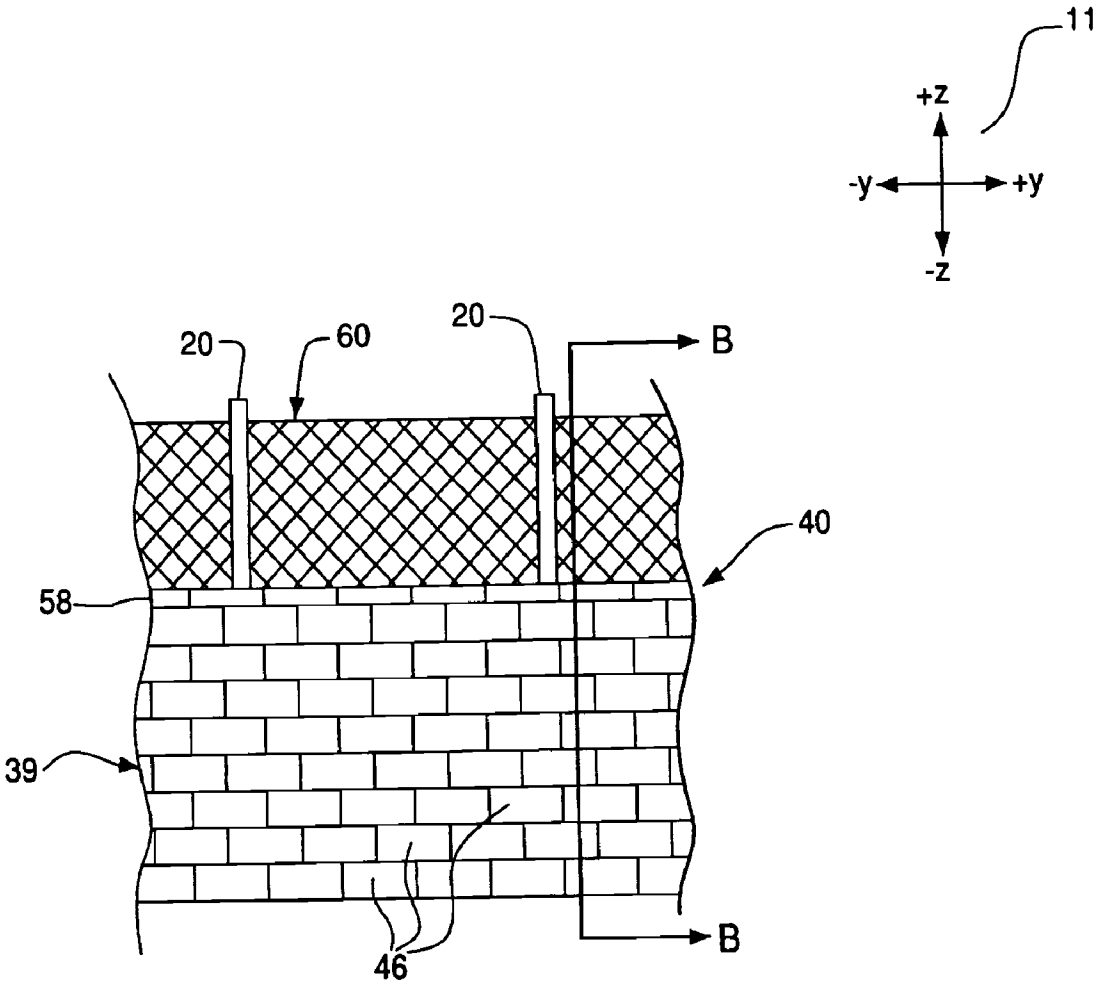
FIG. 9 is a front view of a wall, and a fence having fence-post footings constructed using the device shown in FIGS. 1 and 2.

The sleeve 12 can be formed from a suitable material such as HDPE, using a suitable process such as injection molding (other materials and other manufacturing processes can be used in the alternative). The thickness of the main portion 22 should be sufficient to withstand the forces generated by the backfill material placed around the sleeve 12 and compacted during construction of the segmental retaining wall 40 behind which the device 10 is installed (discussed below) (the wall 40 is depicted in FIGS. 9 and 10). (The term "backfill material," as used throughout the specification and clams, refers to filling material, such as crushed stone or soil, used to fill the area behind the wall face 39 of the wall 40.)

The sleeve 12 also includes a bottom portion 36. The bottom portion 36 preferably includes a first half 36*a* that adjoins the first half 22*a* of the sleeve 22, and a second half 36*b* that adjoins the second half 22*b* of the sleeve 22 (see FIGS. 4 and 5). The first and second halves 36*a*, 36*b* each can have two holes 38 formed therein. The first half 36*a* also has two slits 41 formed therein (see FIG. 5). The slits 41 substantially align with respective ones of the slits 32 formed in the first half 26*a*.

The leg 16 of the reinforcing member 14 adjoins the base 18, as discussed above. Preferably, the leg 16 and the base 18 are substantially perpendicular, i.e., the first and second portions 16, 18 preferably are separated by an angle of approximately ninety degrees. This angle is desirable for nesting and optimization of packaging and freight scenarios.

The main portion 22 is preferably manufactured using a method in which varying wall thicknesses can be achieved using the same type molding process; the thickness for a particular application is dependent on the end use of the sleeve 12. Suitable manufacturing processes include, but are not limited to extrusion blow molding, extrusion, and thermoforming.

The main portion 22 is preferably formed from high density polyethylene (HDPE). HDPE can be subjected to a relatively wide range of environmental conditions, and is strong yet flexible enough to handle abuse during packaging, shipping, assembly, and installation. The use of HDPE is disclosed for exemplary purposes only; the sleeve 12 can be formed from other materials in the alternative.

Corrugated ribs 306, as shown in FIG. 13, may be formed in the wall of the main portion 22, to add strength to the main portion 22 without necessarily increasing the wall thickness. Forming the ribs 306 in the main portion 22 is believed to be a cost effective way to manufacture the main portion 22 for a variety of applications and price points.

Figure 7:
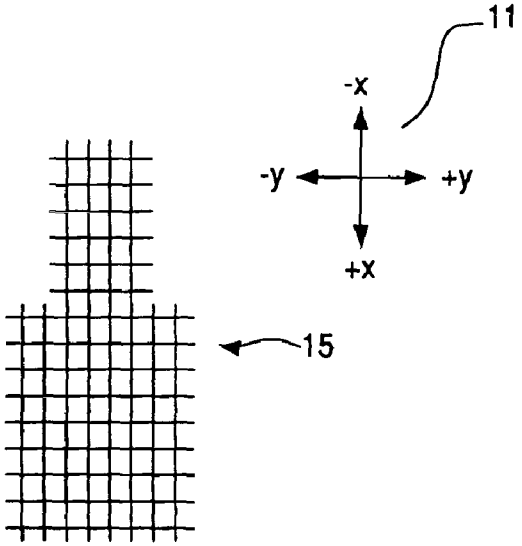
FIG. 7 is a top view of a piece of wire mesh used to form the reinforcing member shown in FIG. 6.

The reinforcing member 14 preferably is formed from wire mesh. For example, the reinforcing member 14 can be formed from a piece 15 of wire mesh having the shape depicted in FIG. 7. In particular, the piece 15 can be cut or otherwise formed to include a relatively narrow portion having the desired dimensions of the leg 16, and a relatively wide portion having the desired dimensions of the base 18. The piece 15 then can be bent or otherwise formed into the desired shape of the reinforcing member 14, i.e., the piece 15 can be bent so that the relatively narrow portion is substantially perpendicular to the relatively wide portion. The wire sizes within the reinforcing member 14 can be varied and are application dependent. (The leg 16 and base 18 can be formed separately, and secured to each other (either directly or indirectly) by a suitable means in alternative embodiments.)

The width ("y" axis dimension") and length ("z" axis dimension) of the leg 16 preferably are selected so that the leg 16 can fit within the main portion 22 of the sleeve 12. The optimal dimensions of the base 18 are application dependent, and can vary with factors such as the amount of force the device 10 needs to produce to counteract external forces on the fence post 20 (discussed below).

Figure 8:
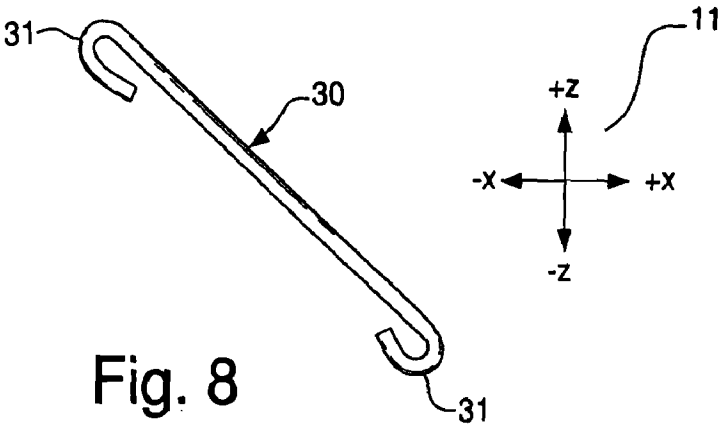
FIG. 8 is a side view of the strut shown in FIG. 6.

The device 10 preferably comprises two struts 30. Each strut 30 preferably has a hook portion 31 formed at each end thereof (see FIG. 8). The hook portions 31 at a first end of each strut 30 engage one of the wires of the leg 16 of the reinforcing member 14. The hook portions 31 at a second end of each strut 30 engage one of the wires of the base 18. The size and number of struts 30 can vary and are application dependent. (Alternative embodiments can be formed without the struts 30.)

The reinforcing member 14 and the struts 30 should be formed from a material (or materials) having suitable strength to withstand the forces exerted thereon by the fence post 20 and the backfill material placed around in device 10 during installation thereof (discussed below). The material from which the reinforcing member 14 and the struts 30 are formed should also possess sufficient corrosion resistance for potential use in moist soil. Moreover, the material from which the reinforcing member 14 is formed should be sufficiently malleable to permit the reinforcing member 14 to be formed from the piece 15 of wire mesh in the above-described manner.

The slits 32 formed in the main portion 22 and the slits 41 formed in the bottom portion 36 of the sleeve 12 can facilitate attachment of the sleeve 12 to the reinforcing member 14. In particular, the struts 30 can be inserted into respective ones of the slits 32 as the sleeve 12 is placed over the leg 16. (The slits 41 permit the struts 30 to enter the slits 32.) A portion of each strut 30 moves upward in the associated slit, and eventually enters the opening 34 formed above the slit 32 as the sleeve 12 is advanced over the reinforcing member 14.

The portions of the struts 30 that enter the openings 34, it is believed, will remain in the associated opening 34 until the sufficient downward force is exerted on the reinforcing member 14 to drive the struts 30 back into the associated slits 32. This feature can help retain the reinforcing member 14 in place on the sleeve 12 before and during installation of the device 10.

The base 18 preferably extends from the sleeve 12 in a direction substantially perpendicular to the longitudinal axis of the sleeve. (The longitudinal axis the sleeve 12 is denoted the line "A" in FIG. 2.)

Figure 10:
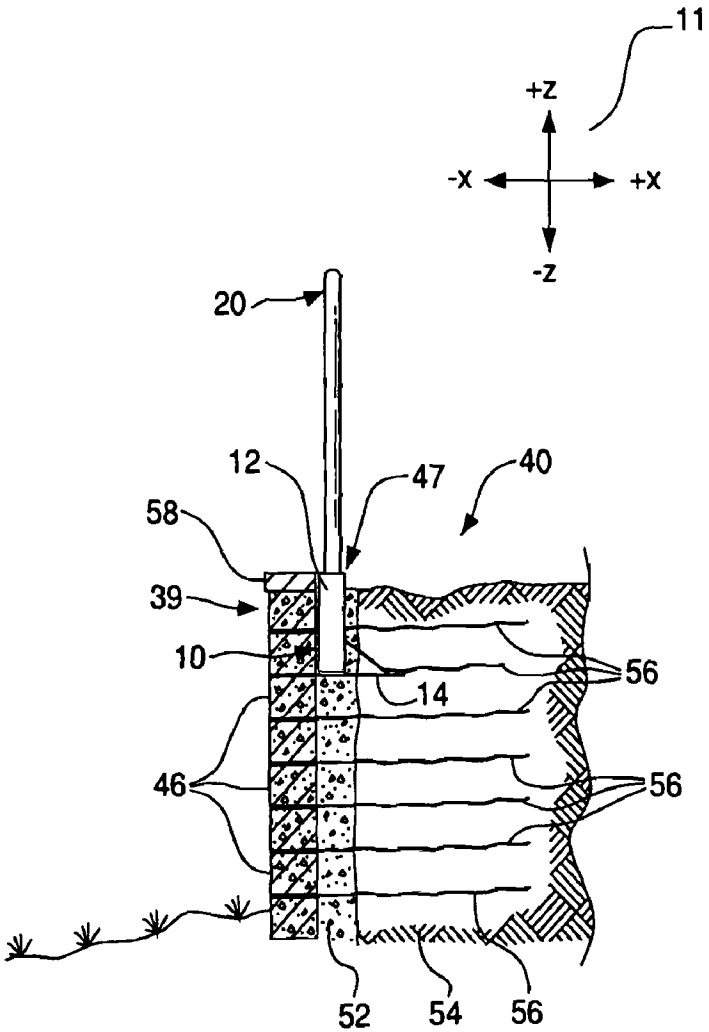
FIG. 10 is a cross-sectional view of the wall and fence shown in FIG. 9, taken through the line "B-B" of FIG. 9.

The device 10 can be used to form a footing 47 for a fence post, such as the fence post 20, when the fence post 20 is installed behind the segmental retaining wall 40 (see FIGS. 10 and 11).

The segmental retaining wall 40 can initially be constructed in a conventional manner. For example, a trench for receiving a lowermost (base) row of blocks 46 can be excavated along the planned path of the wall 40 (the blocks 46 can be, for example, mortarless concrete blocks). The ground at the bottom of the trench can be stabilized and compacted using a vibrating mechanical plate. The base row of blocks 46 can be placed in the trench and leveled.

The voids in each block 46 can be filled with crushed stone or other suitable material. The area in back of the blocks 46 can be backfilled to the approximate height of the blocks 46 using crushed stone 52 or other suitable material. The area behind the crushed stone can be filled with on-site soil 54. (Filling material other than the crushed stone 52 and on-site soil 56 can be used as backfill, in the alternative). The soil 54 can be compacted, preferably to approximately ninety-five percent of maximum density. (The crushed stone and soil used as backfill hereinafter are referred to as "the backfill material.")

Successive overlying rows of blocks 46 can be formed in a similar manner. A reinforcing tie back subsystem, such as sheets of geogrid 56, can be attached to each row of blocks 46. The sheets of geogrid 50 can extend outward from the blocks 46, onto the adjacent layer of backfill material, by a predetermined distance. Each sheet of geogrid 50 should be tensioned before being covered by the overlying layer of backfill material.

The device 10 should be installed so that the top of the sleeve 12 is accessible from above ground after the wall 40 has been completed and back-filled (see FIG. 10). For example, in an application where the main portion 22 of the sleeve 12 is approximately 24 inches long and the each block 46 is approximately six to eight inches high, the device 10 should be placed on the layer of backfill material associated with the row of blocks 46 twice removed from the uppermost row.

Stakes (not shown) can be driven through the holes 38 formed in the first and second halves 36*a*, 36*b* of the bottom portion 36 of the sleeve 12. The stakes can help to stabilize and secure the device 10 in place before and during placement of the backfill material around the device 10. (The weight of the backfill material acting on the bottom portion 36 of the sleeve 12 also can help to stabilize the device 10 during installation.)

The device 10 optimally should be positioned so that the main portion 22 of the sleeve 12 contacts the adjacent row of blocks 46 (see FIG. 10). Positioning the device 10 in this manner can help to minimize the spacing the between the fence post 20 and the wall 40 when the fence post 20 is subsequently installed. Moreover, positioning the device 10 in this manner places all, or at least a portion of the sleeve 12 on the underlying crushed stone.

The spacing between adjacent ones of the devices 10 is dependent upon the desired distance (spacing) between adjacent ones of the fence posts 20. The notch 27 defined by the cover portion 26 can receive the tab (not shown) commonly located on the end of conventional tape measures. The notch 27 can act as a convenient means for holding the tab at the approximate center of the device 10 as the position of the adjacent device 10 is determined based on measurements obtained from the tape measure.

The remaining rows of blocks 46 and layers of backfill material can subsequently be completed, in substantially the same manner as the previous the rows and layers. Caps 58 can be installed on top of the uppermost row of blocks 46, if desired.

The sheets of geogrid 50 located at the same level (z-axis position) as the sleeve 12 can be slit, so that sheets of geogrid 50 can be wrapped around the main portion 22.

The sleeve 12 forms a cavity in the backfill material. The cavity can accommodate the bottom portion 20*a* of the fence post 20. The device 10 can remain in place, with the cover portion 26 installed, until the fence post 20 is about to be installed. The cover portion 26 can prevent substantial amounts of soil or other debris from falling into the cavity formed by the sleeve 12 before the fence post 20 is installed. Moreover, the cover portion 26 can reduce or eliminate the potential for injuries caused by tripping over or stepping into an open hole in the ground. (Hence, the cover portion 26 can be particularly beneficial in applications where the fence post 20 will not be installed immediately upon completion of the wall 40.)

The cover portion 26 can be removed by cutting the first and second halves 26*a*, 26*b* of the cover portion 26 along the areas 28 of reduced-thickness. The reduced-thickness areas 28, it is believed, make it possible to cut through the cover portion 26 with minimal difficulty, using simple tooling such as a manual saw, a utility knife, etc.

The above-mentioned removal of cover portion 26 can also be done in the manufacturing facility for shipping and handling-related reasons. The lid is placed on the sleeve 12 during installation and then removed when the fence post 20 is to be installed.

The lower portion 20*a* of the fence post can be placed in the main portion 22 after the cover portion 26 has been removed. A suitable anchoring material such as the concrete 23 can be poured into the main portion 22 of the sleeve 12 once the cover portion 26 has been removed.

The concrete 23 fills the main portion 22, and immerses the lower portion 20*a* of the fence post 20, the leg 16 of the reinforcing member 14, and a portion of the base 18 of the reinforcing member 14, and the struts 30 (see FIG. 11). The lower portion of the post 20*a* can be on the inboard or outboard sides of the vertical leg 16. The concrete 23 (upon hardening), the leg 16, the portion of the base 18 immersed in the concrete form a reinforced concrete footing 47 for the fence post 20. (The leg 16 is depicted in FIG. 11 as being located behind the bottom portion 20*a* of the fence post 20. The leg 16 can be located in front of the bottom portion 20*a* in the alternative.)

The footing 47 can reinforce the fence post 20. In particular, the fence post 10 can be subject to an external force that generates a counterclockwise moment thereon (from the perspective of FIG. 11). (This force and moment are denoted by the reference symbols "$F_1$" and "$M_1$," respectively, in FIG. 11.) The moment $M_1$, when excessive, can potentially weaken or collapse the wall face 39 of the wall 40 if the fence post 10 is located directly adjacent the wall face 39.

The weight of the backfill material above the base 18 of the reinforcing member 14 causes the backfill material to exert a downward force "$F_2$" on the base 18. (Soil compacted to ninety-five percent of maximum density weighs approximately 125 pounds per cubic foot. Hence, the force $F_2$ can potentially be substantial.)

The force $F_2$ can generate a clockwise moment "$M_2$" that acts on the fence post 20 by way of the footing 47 (see FIG. 11). A portion of the force associated with the moment "$M_2$" is transferred to the footing 47 by way of the struts 30, thereby reducing stress on the base 18. The base 18 is believed to function as a cantilever that, in conjunction with the struts 30, counteract the counterclockwise moment $M_1$ generated by the force $F_1$.

The magnitude of the moment $M_2$ can be varied by varying the total surface area of the base 18 on which the backfill material acts in a downward fashion. This can be achieved, for example, by varying the size of the mesh from which the reinforcing member 14 is formed, or by varying the overall size of the base 18.

The force $F_1$, in addition to generating the moment $M_1$, urges the fence post 20 toward the wall ace 39. The force $F_1$, if excessive, can cause overturning or direct sliding of the fence post 20 toward the wall face 39. Such overturning or sliding can potentially weaken, bulge, or overturn the wall face 39 if the fence post 10 is located directly adjacent the wall face 39.

The device 10 can generate a force "$F_3$" that counteracts the force the $F_1$ (see FIG. 11). In particular, the backfill material within each individual mesh on the base 18 can exert an aggregate force on the base 18 (represented by the force $F_3$) in response to the force $F_1$. (The use of wire mesh for the reinforcing member 14 is preferred (but not absolutely required), because the individual meshes create a greater amount of surface area on the base 18 to react the force $F_1$ through contact with the backfill material. Other types of materials, e.g., sheet metal with or without holes formed therein, can be used in the alternative.)

The magnitude of the force $F_3$ can be varied by varying the total amount of surface area on the base 18 that faces the "−x" direction (so as to react the force $F_1$ through contact with the backfill material). This can be achieved, for example, by varying the size of the mesh from which the reinforcing member 14 is formed, or by varying the overall size of the base 18.

Many design codes and site plans require a fence post installed directly adjacent a segmental retaining wall to withstand an applied load of approximately twenty pounds per linear foot of fence. The use of the device 10, it is believed, provides the fence post 20 with sufficiently reinforcement to meet this standard. In particular, the moment $M_2$ and the force $F_3$ exerted by the device 10 on the fence post 20 can counteract the moment $M_1$ and the force $F_1$, and thereby reduce the potential for the $M_1$ and the force $F_1$ to weaken, bulge, overturn, or otherwise affect the wall face 39 when the fence post 20 is installed immediately adjacent the wall face 39.

The use of the device 10, by permitting the fence post 20 (and the associated fence 60) to be installed directly adjacent the wall face 39, can obviate the need for a setback between the wall face 39 and the fence 60. Hence, the underutilization of real estate, and the potential safety hazard resulting from the use of such setbacks can be eliminated.

Eliminating the need for a setback also can eliminate the potential for mistakenly installing the fence 60 too close to the wall face 39 in violation of a design code or site plan. Hence, the potential need to remove and reinstall the fence 60 due to such mistakes can be reduced or eliminated through the use of the device 10. Moreover, the footing 47, it is believed, can be constructed without using substantially more concrete than a footing constructed in a conventional manner.

Placing the device 10 directly adjacent the wall face 39 also can reduce the potential for the sleeve 12 to interfere with the compacting operations performed on the backfill soil 54. In particular, placing the device 10 directly adjacent the wall face 39 can cause most, or all of the sleeve 12 to extend through the crushed stone 52. Hence, a substantial portion of the sleeve 12 does not extend through the soil 54. The sleeve 12 therefore does not interfere substantially with the compacting operation performed on the soil 54. Moreover, this arrangement can facilitate the use of larger compacting equipment than otherwise would be possible, because the compacting equipment does not need to be maneuvered around the sleeves 12.

The split configuration of the sleeve 12 permits the sleeve 12 to be shipped in a relatively compact, unassembled condition. In particular, the halves of each unassembled sleeve 12 can be stacked, and placed in a relatively small box or container for shipping. As the volume of each sleeve 12 in an unassembled condition is substantially less than its volume in an assembled condition, the ability to disassemble the sleeve 12 into two halves can make it relatively easy and inexpensive to ship the sleeves 12, particularly where a relatively large number of sleeves 12 are shipped together.

The sleeve 12 can be manufactured and shipped to the user in a predetermined height, thereby eliminating time, effort, and potential hazards associated with the need to cut the sleeve 12 to size at the installation site. Moreover, the sleeve 12 can be formed from a durable material, such as HDPE, that is substantially impervious to moisture in the soil in which it is buried, and that can withstand the loads generated by the backfill material on the sleeve 12 is buried.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the invention as defined by the appended claims.

Figure 15:
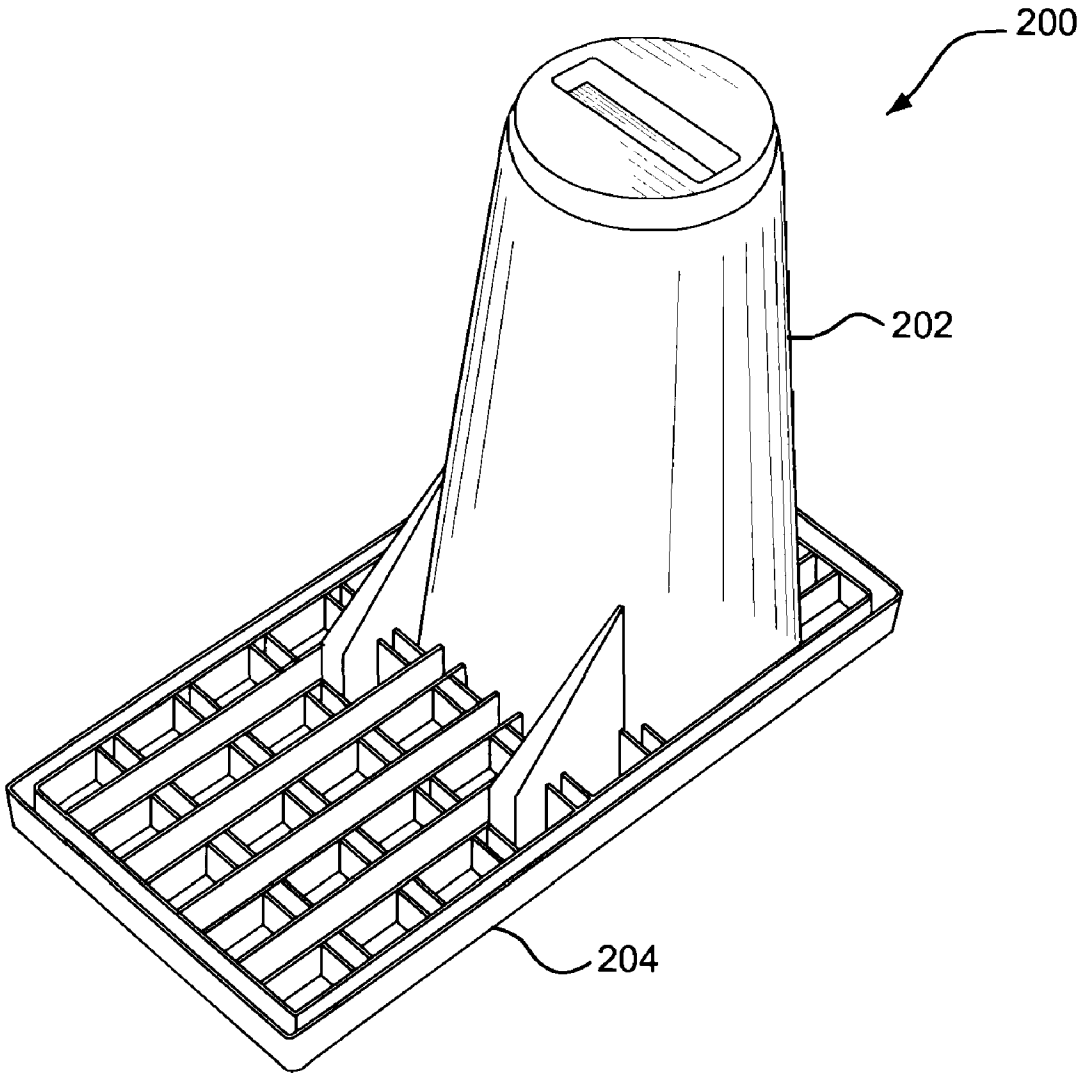
FIGS. 15 and 16 are respective top and bottom perspective views of another alternative embodiment of the device shown in FIGS. 1, 2, 10, and 11.
Figure 16:
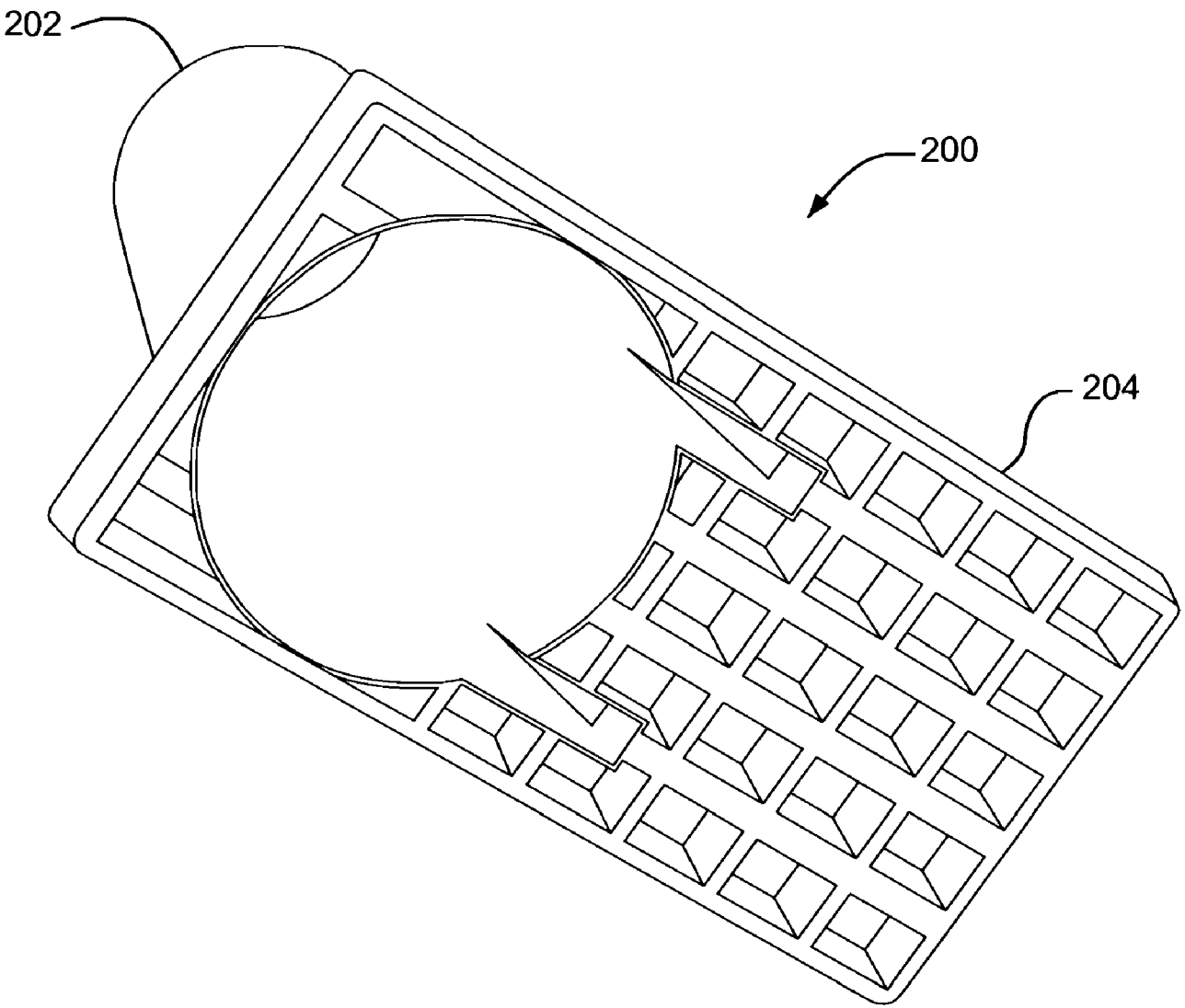

For example, device sleeve 12 and the reinforcing member 14 can be formed as a unitary structure, using techniques such as injection molding. FIGS. 15 and 16 depict one such embodiment in the form of a device 200 having a sleeve 202 and a reinforcing member 204 that is unitarily formed with the sleeve 202.

The sleeve 12 can be used by itself, without the reinforcing member 14 or the struts 30. (The footing produced using the sleeve 12 alone, however, will not be able to provide the same degree of reinforcement as the footing 47 produced using the device 10.)

Figure 12:
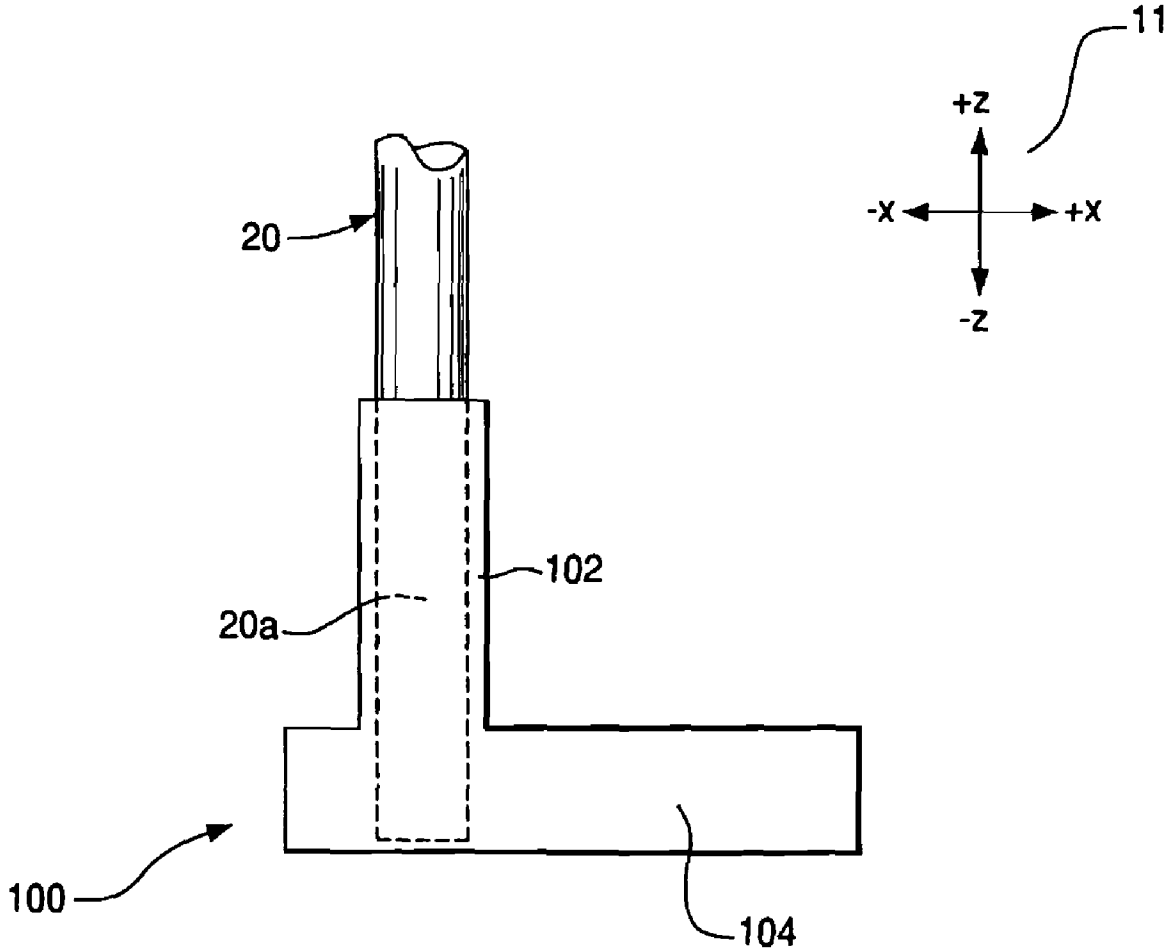
FIG. 12 is a side view of an alternative embodiment of the device shown in FIGS. 1, 2, 10, and 11

FIG. 12 depicts an alternative embodiment of the device 10 in the form of a device 100. The device 100 comprises a first sleeve 102, and a second sleeve 104 secured to the first sleeve 102. The device 100 can be placed directly adjacent the wall 40 and covered with backfill material so that the top of the first sleeve 102 remains above ground, in a manner similar to that described in relation to the device 10. A reinforcing bar (not shown) can be positioned within the first sleeve 102. The reinforcing bar can be coupled to the first sleeve 102 by a reinforcing bar chair (also not shown).

The first sleeve 102 can receive the bottom portion 20*a* of the fence post 20. The first and second sleeves 102, 104 can be filled with a suitable anchoring material (not shown), such as the concrete 23, introduced by way of the open top of the first sleeve 102.

The device 100 can generate reactive forces in response to a linear force applied to the fence post 20 in the "−x" direction, in a manner substantially similar to device 10. The device 100 can be equipped with the various features of the device 10, e.g., a cover for the top of the first sleeve 102, a split configuration, etc.

Various building codes are in place for a variety of fencing and guard rail scenarios. In some scenarios, a fence may need to resist a 200-pound concentrated load. In other instances, the same fence may need to resist a 500-pound concentrated load. The particular requirements for a given application can depend on many variables, including the accessibility of the area to the public, specific wind load requirements in areas prone to relatively strong winds, etc.

The requirements imposed by codes for vehicular guard rails can also vary by application. For instance, in a privately owned parking lot the applicable code may only require resistance to a 6000-pound concentrated load. The entrance to the parking lot from the roadway, however, may be under the jurisdiction of the municipality or state. A guardrail installed at the entrance may therefore be subject to a different code requirement, e.g., resistance to a 10,000-pound concentrated load.

Figure 14:
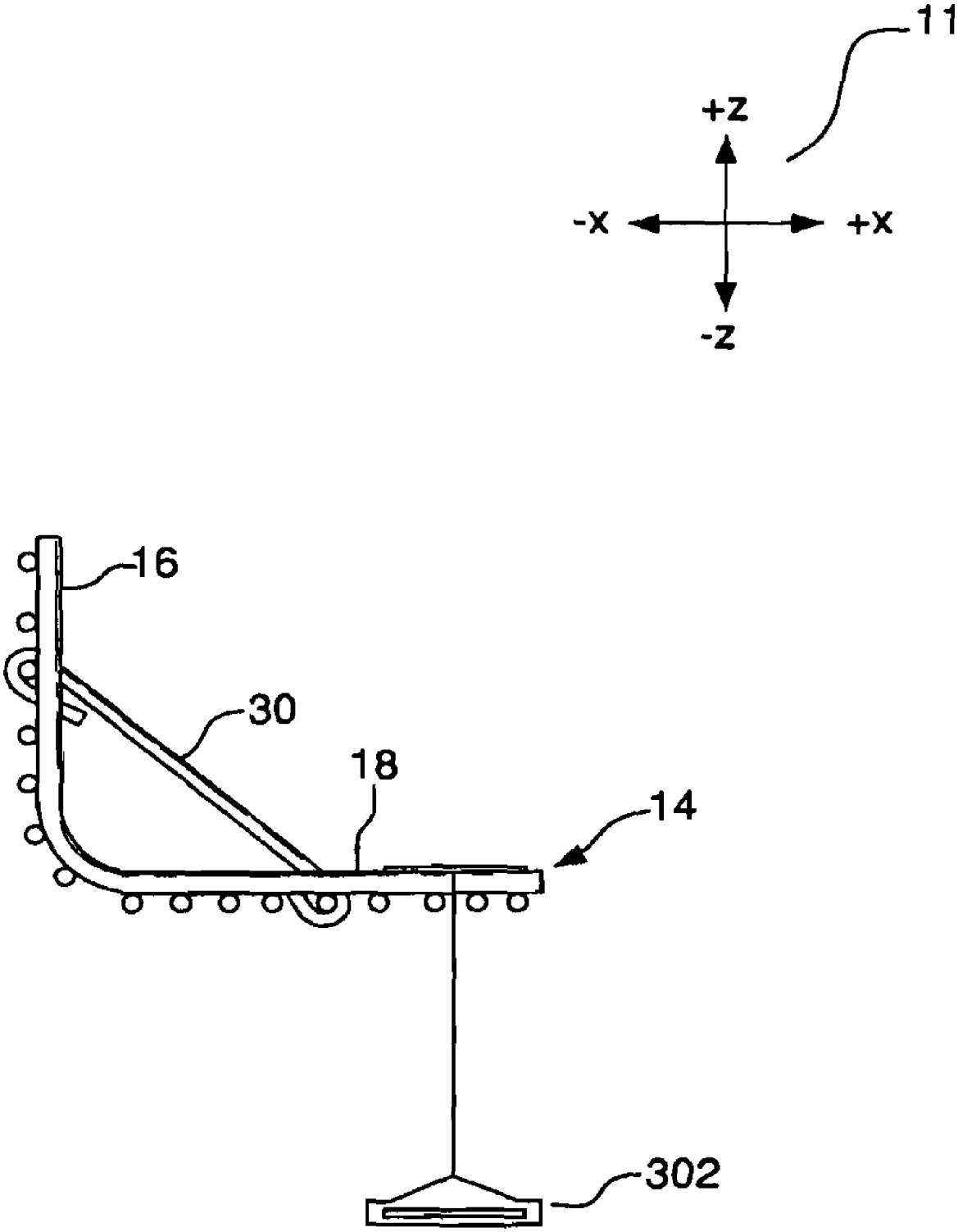
FIG. 14 is a side view of the device shown in FIGS. 1, 2, 10, and 11, used in conjunction with an earth anchor.

In consideration that the market opportunity for versions of the device 10 configured to meet the least stringent of two or more potentially applicable codes, an accessory can be used to increase the resistance of the device 10 to the moment "$M_1$" depicted in FIG. 11, by supplementing the downward force "$F_2$" exerted by the backfill material on the base 18 of the reinforcing member 14. The accessory can be, for example, a relatively low-cost earth anchor 302, shown in FIG. 14, as is commonly used to add additional load carrying capabilities to a variety of structures. For example, earth anchors are sometimes attached to telephone poles via a cable, to permit the pole to be placed in a shallower footing, while maintaining resistance of the pole to overturning under a wind load or another force.

The earth anchor 302 can be attached to the base 18 of the reinforcing member 14, so that the earth anchor 302 extends downward into the soil below the base 18, to engage additional resisting soil mass below the base 18. This feature allows the device 10 to be manufactured at a relatively low cost for a more common, lower-load application of the device 10.

The earth anchor 302 can be used in applications where the device 10 needs to meet a relatively high load requirement, e.g., a 10,000-pound concentrated load. The device 10 therefore can be constructed and priced for the lower load application, and can be used in the higher-load application in conjunction with the earth anchor 302. Strengthening devices other than the earth anchor 302 can be used in the alternative.

The base 18 of the reinforcing member 14, and a portion of the struts 30 are exposed to backfill material when the device 10 is installed. The backfill material of a segmental retaining wall can be made up of a wide variety of soil types, depending on the project location. Soils can greatly affect the integrity of steel elements embedded in the soil for an extended period of time. The integrity of the steel is affected by a phenomenon commonly referred to as corrosion.

Corrosion can occur at different rates dependent on the environment to which the steel element is exposed. For example, granular soils consisting of sands and gravels generally allow for a more freely draining environment. Silts and clays can create a poorly drained environment. The silts and clays represent high water content soils, and can substantially increase the rate of corrosion.

Silt and clay soils are commonly used behind segmental retaining walls. Consequently, the base 18 of the reinforcing member 14 and the struts 30 preferably have some form of corrosion protection, to help ensure the intended life expectancy of the device 10. There are several methods commercially available for corrosion protection of steel. Some of these methods comprise spraying a corrosion-resistant coating onto the surfaces of the item to be protected. Other methods comprise applying the coating by dipping the item into a volume of the corrosion-resistant material in liquid form, and removing the item from the volume to form a coating of the corrosion-resistance material on the surfaces thereof.

A coating of a corrosion-resistant material is preferably applied to the outer surfaces of the base 18 and the struts 30 by dipping. A dipping process is preferred, as currently-available spray processes can waste a substantial amount of the coating material by, for example, overspray. Moreover, it is believed that the thickness of the coating can be better controlled using a dipping process in lieu of a spray process.

Galvanization, epoxy coatings, and PVC-type coatings can be used to provide corrosion resistance to the base 18 and the struts 30. The use of a PVC coating is preferred, because the inert quality of PVC allows it to resist a relatively wide range of environmental conditions. Suitable corrosion-protection means other than galvanization, epoxy coatings, and PVC-type coatings can be used in the alternative, and the corrosion-resistant coating can be applied by suitable techniques other than dipping and spray coating.

The durometer, or hardness of the corrosion-resistant coating can be adjusted to lessen the potential for construction damage during the installation of the device 10, and in particular while backfilling over the base 18 and the struts 30. The hardness of the coating should be sufficient to permit the coating to resist pin holes and abrasions, which can result in concentrated areas of corrosion and degraded structural integrity. The coating should be soft, or non-brittle, so that the coating is resistant to cracking and peeling.

A potentially important aspect to the successful commercialization of the device 10 relates to the efficiency in which the device 10 can be packaged, shipped, and stored for future use. The split configuration of the sleeve 12 permits the sleeve 12 to be shipped in a relatively efficient and manner. In particular, the first and second halves 22*a* and 22*b* of the main body 22 can be nested in a relatively compact fashion. Moreover, the design of the cover portion 26 facilitates nesting of the cover portion 26 in a relatively efficient and compact manner around the nested sleeves 12. Also, the design of the reinforcing member 14, and the angle of the vertical leg 16 in relation to the base 18 enable the reinforcing members 14 to be nested tightly together in and around the sleeves 12 and the cover portion 26.

Freight costs are typically charged by assigning a class code based on the type and weight of materials being transported. The shape of the package or pallet in this instance is also an integral part of the shipping cost. The relatively light weight of the components of the device 10, in relation to the volume of the device 10 when the sleeve 22 is in its assembled configuration, do not provide for cost-effective shipping where the freight costs are charged by assigning a class code based on the type and weight of materials being transported.

The nesting capabilities of the device 10, however, facilitate the use of a different shipping-price calculation in which class code and weight have no impact on the freight charge. Shipping the device 10 in the relatively compact nested configuration discussed above permits freight charges to be calculated on a linear basis, which can potentially save the shipper, and ultimately the receiving party or customer up to about 50 percent to about 70 percent of the normal class code charge. Moreover, the pallets on which the boxes containing the nested devices 10 are stacked should be stacked several wide and several high, leaving only a few inches of space around the perimeter to optimize the volume. This stacking arrangement can permit the freight costs to be calculated based on linear spacing which is, in general, a highly cost-effective manner of ordering truck space.

Furthermore, the design of the boxes containing the devices 10 takes into account that the potential distributor of the device 10 may not have much space for storage. The structural integrity of the boxes, and the particular placement of the components of the devices 10 within the boxes can facilitate vertical stacking of several pallets of the device 10 within a relatively small space.

It should be noted that the distributors often prefer to store products such as the device 10 outdoors, to avoid using indoor warehouse space. The outermost box or boxes for the components of device 10 can have a wax coating thereon, so that the boxes are not susceptible to damage from adverse weather conditions. The distributor can thus optimize its storage capabilities, which can be vital to running a productive business.

What is claimed is:

1. A method for creating a footing for a structure proximate a wall face of a segmental retaining wall using a device comprising a sleeve and a reinforcing member having a base, the method comprising placing the device on a layer of backfill material behind the wall face so that the sleeve is located adjacent the wall face and the base of the reinforcing member extends away from the wall face; covering the base of the reinforcing member with at least one other layer of the backfill material; placing a bottom portion of the structure in the sleeve; and filling the sleeve with an anchoring material.

2. The method of claim 1, wherein filling the sleeve with an anchoring material comprises filling the sleeve with concrete.

3. The method of claim 1, wherein placing the device on a layer of backfill material behind the wall face so that the sleeve is located adjacent the wall face and the base of the reinforcing member extends away from the wall face comprises placing the device on the layer of the backfill material behind the wall face so that the sleeve contacts the wall face.

4. The method of claim 1, wherein covering the base of the reinforcing member with at least one other layer of the backfill material comprises covering the base of the reinforcing member with soil.

5. The method of claim 1, wherein placing a bottom portion of the structure in the sleeve comprises placing a bottom portion of a fence post in the sleeve.

6. The method of claim 1, wherein the reinforcing member further comprises a leg positioned within the sleeve.

7. The method of claim 1, further comprising attaching an earth anchor to the base so that the earth anchor extends downwardly into the layer of backfill material on which the device is placed.

8. The method of claim 1, further comprising attaching a strut to the base of the reinforcing member.

9. The method of claim 8, further comprising inserting the strut into a slit formed in the base.

10. The method of claim 1, further comprising placing the sleeve over a leg of the reinforcing member.

11. The method of claim 10, wherein placing the sleeve over a leg of the reinforcing member comprises placing the sleeve over the leg of the reinforcing member so that the base of the reinforcing member extends in a direction substantially perpendicular to a longitudinal axis of the sleeve.

12. The method of claim 1, further comprising removing a cover portion of the sleeve before placing the bottom portion of the structure in the sleeve.

13. The method of claim 1, wherein filling the sleeve with an anchoring material comprises immersing the bottom portion of the structure, a leg of the reinforcing member, and a portion of a base of the reinforcing member with the concrete.

14. The method of claim 1, further comprising securing a first half of the sleeve to a second half of the sleeve by connecting interlocking finger sets formed on the first and second halves of the sleeve.

15. The method of claim 1, further comprising placing a leg of the reinforcing member within the sleeve so that the leg is located in front of or in back of the bottom portion of the structure.

16. The method of claim 1, wherein placing the device on a layer of backfill material behind the wall face so that the sleeve is located adjacent the wall face and the base of the reinforcing member extends away from the wall face comprises placing the device on the layer of backfill material behind the wall face so that the sleeve is located adjacent the wall face, the base of the reinforcing member extends away from the wall face, and a leg of the reinforcing member is located within the sleeve in a substantially vertical orientation.

17. A method for creating a footing for a structure using a device comprising a sleeve and a reinforcing member having a base, the method comprising placing the device on a layer of backfill material behind a wall face so that the sleeve is located adjacent the wall face and the base of the reinforcing member extends away from the wall face; covering the base of the reinforcing member with at least one other layer of the backfill material; placing a bottom portion of the structure in the sleeve; and filling the sleeve with an anchoring material.

18. The method of claim 17, further comprising placing the sleeve over a leg of the reinforcing member.

19. The method of claim 18, wherein placing the sleeve over a leg of the reinforcing member comprises placing the sleeve over the leg of the reinforcing member so that the base of the reinforcing member extends in a direction substantially perpendicular to a longitudinal axis of the sleeve.

20. The method of claim 19, further comprising attaching a strut to the base of the reinforcing member.

* * * * *